US006691359B2

(12) United States Patent
Park et al.

(10) Patent No.: US 6,691,359 B2
(45) Date of Patent: Feb. 17, 2004

(54) WASHING MACHINE AND METHOD OF CONTROLLING THE SAME

(75) Inventors: Choong-Ill Park, Suwon (KR); Yang-Jo Jung, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 259 days.

(21) Appl. No.: 09/930,446

(22) Filed: Aug. 16, 2001

(65) Prior Publication Data

US 2002/0170119 A1 Nov. 21, 2002

(30) Foreign Application Priority Data

May 16, 2001 (KR) ..... 2001-26668

(51) Int. Cl.[7] ..... D06F 33/02

(52) U.S. Cl. ..... 8/159; 68/12.02; 68/12.12; 68/12.14; 68/12.24

(58) Field of Search ..... 8/158, 159; 68/12.02, 68/12.01, 12.06, 12.12, 12.14, 12.16, 12.24

(56) References Cited

U.S. PATENT DOCUMENTS 4,150,303 A 4/1979 Armstrong ..... 307/140
4,329,859 A * 5/1982 Roberts
4,662,193 A * 5/1987 Honda
5,000,015 A * 3/1991 Nakamura et al.
5,012,658 A * 5/1991 Shikamori et al.
5,058,401 A * 10/1991 Nakamura et al.
5,293,760 A * 3/1994 Tani et al.
5,491,859 A * 2/1996 Richardson et al.
5,838,127 A * 11/1998 Young et al.

FOREIGN PATENT DOCUMENTS

JP 3-133490 * 6/1991
JP 3-139396 * 6/1991

* cited by examiner

*Primary Examiner*—Frankie L. Stinson
(74) *Attorney, Agent, or Firm*—Robert E. Bushnell, Esq.

(57) ABSTRACT

A washing machine and a method of controlling the same by braking a spin-drying tub after interrupting the power of a motor for the spin-drying tub is disclosed. The washing machine comprises a mode selection unit for selecting a spin-drying mode, and a spin-drying timer for selecting a spin-drying time. The spin-drying timer includes a spin-drying switch and a motor control switch each having a different operation time. When the spin-drying mode is selected by the mode selection unit, the spin-drying switch of the spin-drying timer is connected to the solenoid of a drain motor and the motor control switch is connected to a motor driving circuit via a starting switch of the drain motor. As the motor control switch is turned off (the spin-drying switch is turned on) at a time earlier than a selected spin-drying time to interrupt power for the motor, the rotation speed of the spin-drying tub is reduced. After this, when the selected spin-drying time has passed, the spin-drying switch is turned off to interrupt power to the solenoid. Accordingly, as braking is performed with a small frictional braking force, lifetime of the braking device can be lengthened due to a reduced abrasion of the brake band and the brake drum, and vibration and noise occurring at the time of braking of the spin-drying tub can be decreased.

17 Claims, 9 Drawing Sheets

WASHING MACHINE AND METHOD OF CONTROLLING THE SAME

CLAIM OF PRIORITY

This application makes reference to, incorporates the same herein, and claims all benefits accruing under 35 U.S.C. §119 from my application entitled WASHING MACHINE AND METHOD THEREOF filed with the Korean Industrial Property Office on May 16, 2001 and there duly assigned Serial No. 2001-26668.

BACKGROUND OF THE INVENTION

1. Field of the Invention

This invention relates, in general, to a washing machine and a method of controlling the same and, more particularly, to a washing machine and a method of controlling the same by interrupting the power of a drive motor before a spin-drying time elapses, thereby stopping a spin-drying tub.

2. Description of the Prior Art

A typical two-tub type washing machine has a washing tub and a spin-drying tub separately set within the housing of the washing machine, with a pulsator provided on the bottom of the washing tub, and a spin-drying motor and a washing motor provided on both sides of the lower portion of the housing for driving the spin-drying tub and the pulsator, respectively. Also, a control panel having a timer for selecting a washing time and a spin-drying time by a user, etc., is provided at one side of the top of the housing.

For such a two-tub type washing machine, when washing time is set by the washing timer after washing water, laundry and detergent are inputted into the washing tub, the pulsator is repeatedly rotated in alternating directions by the washing motor during the washing time so that a washing operation is performed. After completion of the washing operation, the laundry in the washing tub is moved from the washing tub into the spin-drying tub and then the spin-drying time is set by the spin-drying timer, and so the spin-drying tub is rotated at a high speed during the spin-drying time by the spin-drying motor so that a spin-drying operation is performed.

As can be seen from the above description, the two-tub type washing machine is inconvenient in that laundry must be moved from the washing tub to the spin-drying tub after completion of a washing operation and it is problematic in that there is a limitation on a space for installing the washing machine due to the increase of volume of the washing machine by a separation of the spin-drying tub from the washing tub.

In order to solve such inconveniences and problems experienced in the conventional two-tub type washing machine, a one-tub type fully automatic washing machine provided with a spin-drying tub applicable to both washing and spin-drying operations has been proposed. For such a fully automatic washing machine, washing, draining, rinsing, and spin-drying operations are performed automatically when a user inputs laundry into the spin-drying tub and then selects a desired operation course.

However, as such a fully automatic washing machine has to include electrical components, such as a water level sensor and a microcomputer, in order to perform washing, draining, rinsing, and spin-drying operations automatically, there is the problem that the manufacturing cost of the washing machine is increased and it is difficult to maintain or repair the washing machine due to failure of various components.

In view of these shortcomings, a semi-automatic washing machine employing the merits of both the two-tub type washing machine and the fully automatic washing machine has been developed. The semi-automatic washing machine includes a spin-drying tub applicable to both washing and spin-drying operations, and a rotary knob positioned at the top of the housing of the washing machine and allowing a user to select an operation mode of the washing machine as well as a washing time and a spin-drying time.

In such a conventional semi-automatic washing machine, the spin-drying tub is rotatably mounted within an outer tub, with a pulsator installed on the bottom of the spin-drying tub. A drive motor for rotating the spin-drying tub and the pulsator and a power transmission unit for transmitting a driving force of the motor to the spin-drying tub and the pulsator are provided under the outer tub. The power transmission unit is provided with a braking device for braking the spin-drying tub. The braking device brakes or releases the spin-drying tub by pulling or pushing a brake lever connected to a brake band wrapped around the circumferential surface of a brake drum integrated with the spin-drying tub so as to be rotatable along with the tub. In other words, in case of a washing operation, the braking device brakes the spin-drying tub so that the washing operation is performed by the rotation of the pulsator, and in case of a spin-drying operation, the braking device releases the spin-drying tub so that the spin-drying tub is rotated together with the pulsator.

A circuit diagram for a conventional washing machine is shown in FIG. 1. As shown in the drawing, the washing machine consists of a mode selection unit 1 by which a user selects a operation mode (washing, draining, and spin-drying mode) of the washing machine, a washing timer 5 by which a user selects a washing time, and a door switch 2 for supplying or interrupting power in response to an opening or closing of a door. The washing machine also has a spin-drying timer 3 by which a user selects a spin-drying time, a drain motor 4 for controlling a draining operation in conjunction with a braking action of the spin-drying tub, and a motor driving circuit 6 for driving a motor to rotate the spin-drying tub and the pulsator.

The user selects a desired operation mode (washing, draining, and spin-drying mode) by rotating a rotary knob provided on the top of the housing of the washing machine. Switches "SW1" and "SW2" of the mode selection unit are switched according to an operation mode selected by the user.

If the user selects a washing mode, a first switch "SW1" is switched to the "B" side, thereby supplying power to the motor driving circuit 6 via the washing timer 5 so that the pulsator is repeatedly rotated in alternating directions by the motor during a washing time set by the washing timer 5. After the washing time selected by the user elapses, the washing timer 5 interrupts power supplied to the motor driving circuit 6.

When a draining mode for draining washing water is set, the first switch "SW1" is switched to the "A" side and a second switch "SW2" is turned off. When the first switch "SW1" is switched to the "A" side, power is supplied to a solenoid "SL" of the drain motor 4 via the door switch 2 and the spin-drying timer 3. The brake lever is pulled by an actuation of the solenoid "SL" so that the spin-drying tub is released and a drain port of the outer tub is opened to drain washing water. At this time, as the second switch "SW2" remains off, power to the motor driving circuit 6 is interrupted to stop the motor.

When the user selects a spin-drying mode using the mode selection unit 1 and selects a spin-drying time using the spin-drying timer 3, the first switch "SW1" is switched to the "A" side and the second switch "SW2" is switched to a "C" side. When the first switch "SW1" is switched to the "A" side, power is supplied to the solenoid "SL" of the drain motor 4 via the door switch 2 and the spin-drying timer 3. When the brake lever is slowly pulled and, after a certain period of time (about 7–10 seconds) elapses, has been completely pulled by an actuation of the solenoid "SL", the brake band is detached from the brake drum by the brake lever so that the spin-drying tub is released and a drain port of the outer tub is opened. With the spin-drying tub released thus, when the second switch "SW2" is switched to the "C" side, power is supplied to a starting switch "SW3" which in turn supplies power to the motor driving circuit 6 after a certain period of time (7–10 seconds) elapses. Accordingly, the spin-drying tub and the pulsator are rotated at a high speed by the motor. After this, when the spin-drying time selected by the user is passed, as the spin-drying timer 3 interrupts power supplied to the solenoid "SL", the brake lever is unrestricted so that the brake band comes into contact with the brake drum to brake the spin-drying tub.

With such a conventional washing machine, as the spin-drying tub rotating at a high speed by the motor is suddenly braked by the contact of the brake band with the brake drum when spin-drying time has elapsed, the problems are present that lifetime of the braking device becomes short due to an accelerated abrasion of the brake band, in addition to increased vibration and noise occurring at the time of braking of the spin-drying tub.

SUMMARY OF THE INVENTION

Accordingly, the present invention has been made keeping in mind the above problems occurring in the prior art, and an object of the present invention is to provide a washing machine and a method of controlling the same, which are capable of lengthening the lifetime of a braking device and reducing vibration and noise occurring at the time of braking of the spin-drying tub by interrupting the power to a motor before spin-drying time has elapsed.

In order to accomplish the above object, according to an aspect of the present invention, a washing machine selected in its operation mode and operation time by a user, comprises a spin-drying tub provided in an outer tub for performing both washing and spin-drying operations; a motor for rotating the spin-drying tub; a braking means for braking the spin-drying tub; a mode selection means for selecting a spin-drying mode; and a spin-drying timer for interrupting power to the motor before the spin-drying tub is braked in the spin-drying mode so that the spin-drying tub continues to rotate by its own inertia.

According to another aspect of the present invention, a method of controlling a washing machine selected in its operation mode and operation time by a user, comprises the steps of selecting a spin-drying mode and a spin-drying time; rotating a spin-drying tub by supplying power to a motor in the spin-drying mode; interrupting power to the motor before the selected spin-drying time has elapsed so that the spin-drying tub is rotated by its own inertia; and braking the spin-drying tub after the selected spin-drying time has elapsed.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DESCRIPTION OF THE PREFERRED EMBODIMENTS

Figure 1:
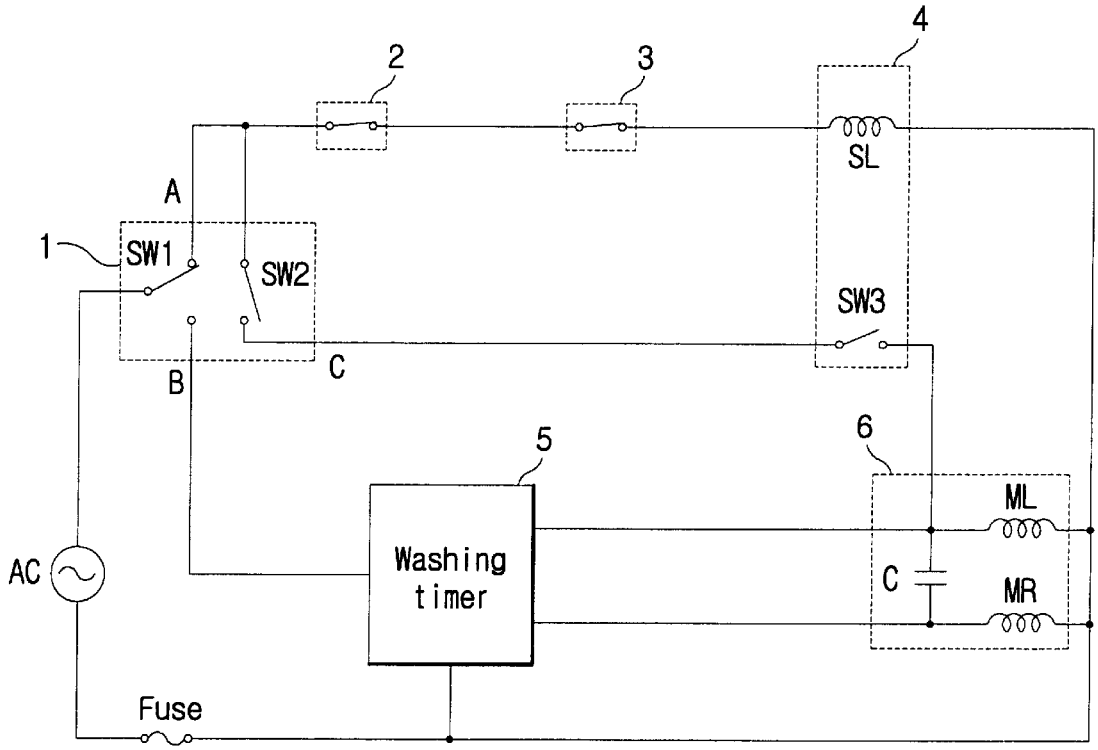
FIG. 1 (PRIOR ART)
FIG. 1 is a driving circuit diagram of a conventional washing machine.

Reference now should be made to the drawings, in which the same reference numerals are used throughout the different drawings to designate the same or similar components.

Now, preferred embodiment of the present invention will be hereinafter described in detail with reference to the accompanying drawings.

Figure 2:
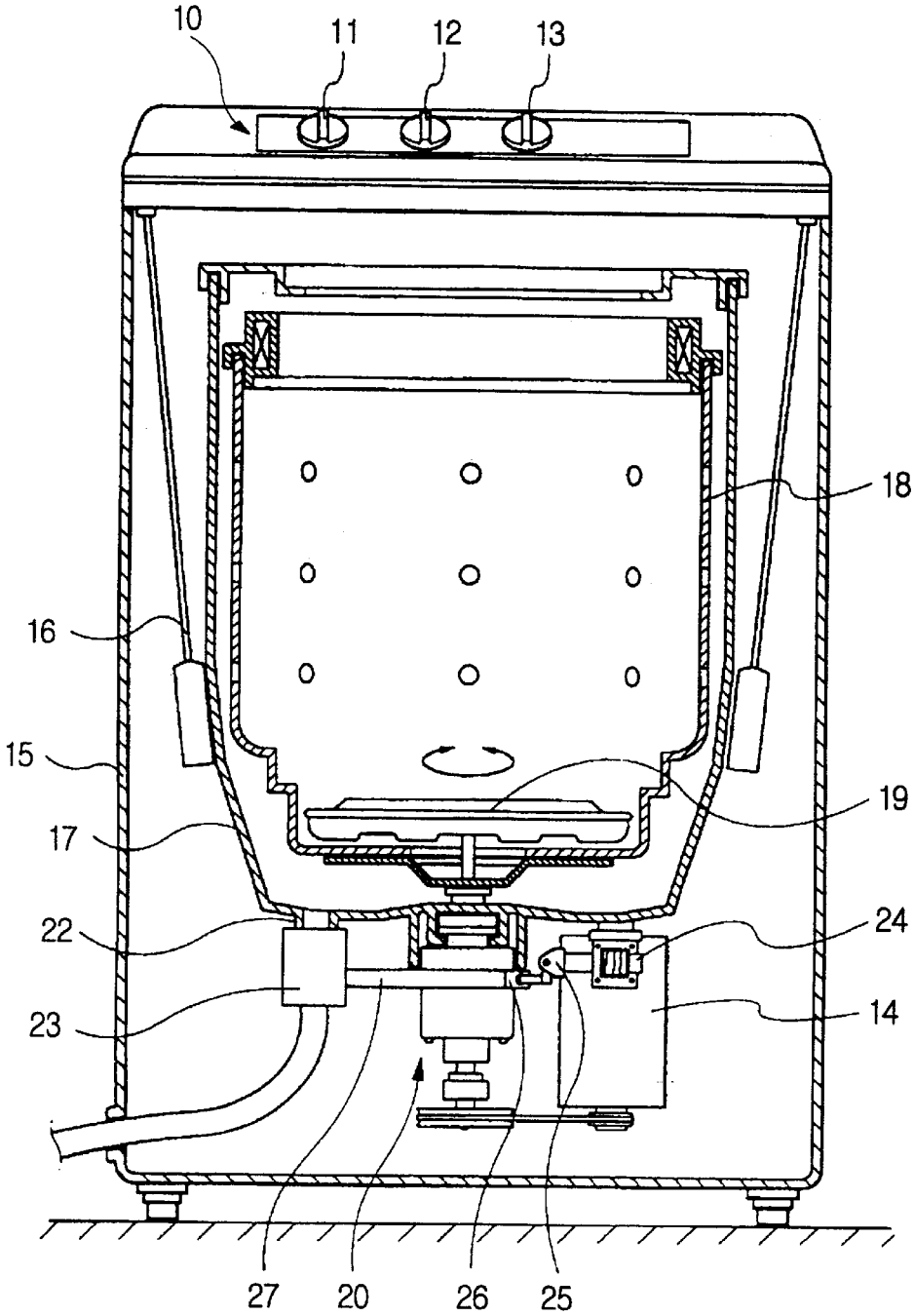
FIG. 2 is a cross-sectional view of a washing machine according to the present invention.
Figure 3:
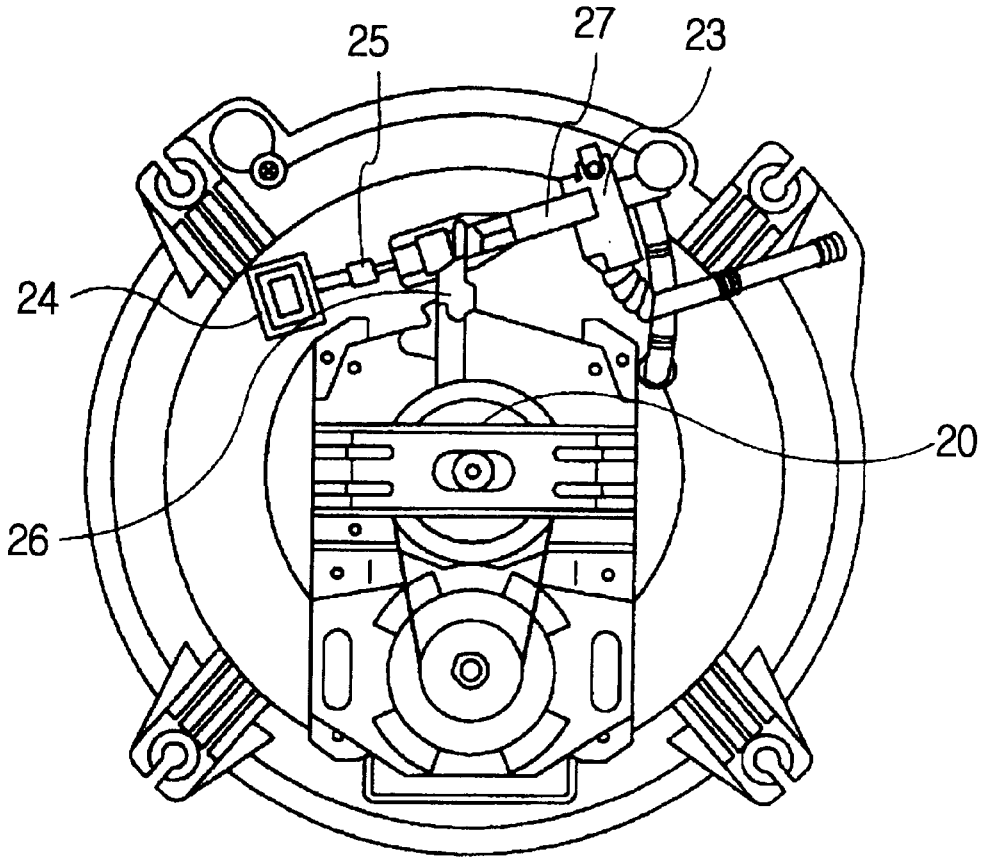
FIG. 3 is a plan view of a braking device of the washing machine according to the present invention.
Figure 4:
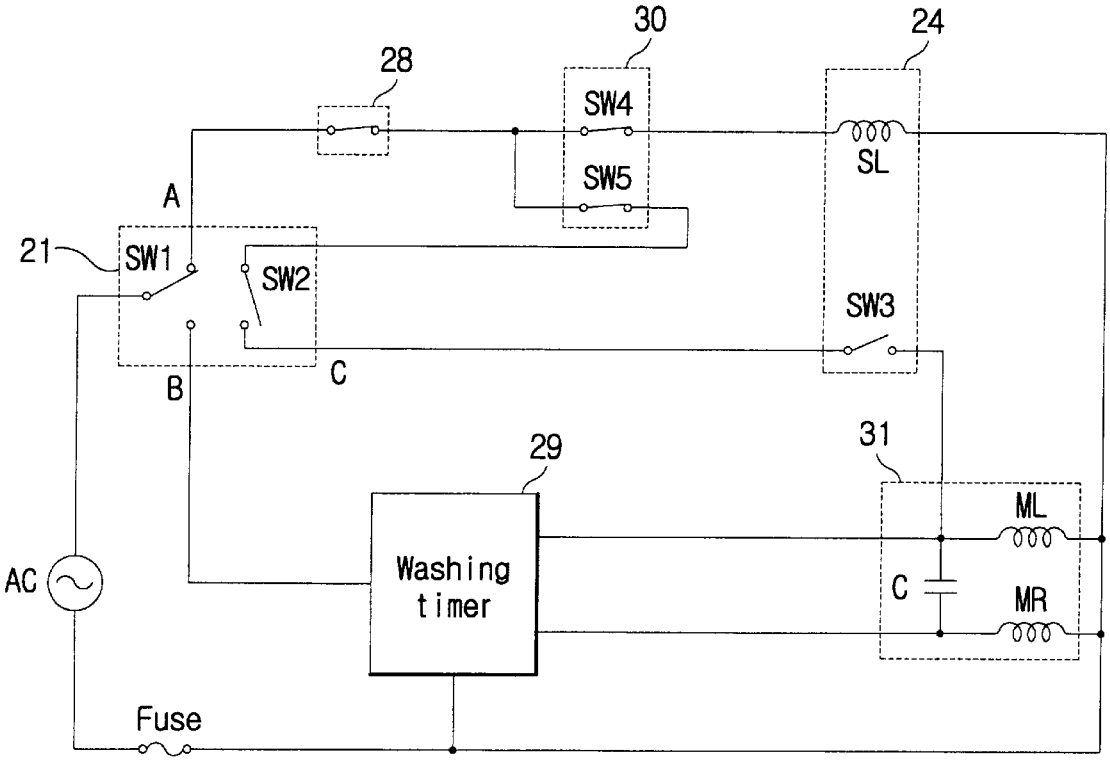
FIG. 4 is a driving circuit diagram of the washing machine according to the present invention.

FIG. 2 is a cross-sectional view of a washing machine according to the present invention, FIG. 3 is a plan view of a braking device of a washing machine according to the present invention, and FIG. 4 is a driving circuit diagram of a washing machine according to the present invention.

As shown in the drawings, the washing machine according to the present invention includes a first rotary knob 11 for selecting an operation mode of the washing machine by a manipulation of a user, a second rotary knob 12 for selecting washing time by a manipulation of a user, and a third rotary knob 13 for selecting spin-drying time by a manipulation of a user, each of the knobs 11, 12, and 13 provided in a control unit 10 provided on the top of the housing 15 of the washing machine. In addition, an outer tub 17 supported by a plurality of suspension bars 16 and containing washing water is provided within the housing 15, and a spin-drying tub 18 is provided within the outer tub 17.

In addition, a pulsator 19 for washing laundry by generating a stream of water in washing water contained in the outer tub 17 is provided within the spin-drying tub 18. A drive motor 14 for rotating the spin-drying tub 18 and the pulsator 19 is provided on the bottom of the outer tub 17. A power transmission unit 20 for transmitting a driving force of the motor 14 to the spin-drying tub and the pulsator 19 is provided on one side of the motor 14. The power transmission unit 20 is provided with a braking device, which includes a brake drum integrated with the spin-drying tub 18 so as to be rotatable along with the tub 18, a brake band wrapped around the circumferential surface of the brake drum, and a brake lever 26 connected to the brake band.

In addition, a drain motor 24 connected to the brake lever 26 via a connection lever 25 is provided below the outer tub 17, and consists of a solenoid "SL" and a starting switch "SW3". When power is supplied to the solenoid "SL", the connection lever 25 is slowly pulled and then, when a certain period of time (about 7–10 seconds) has passed, the brake band is completely detached from the brake drum by the connection lever 25 so that the spin-drying tub 18 is released. In addition, when power to the solenoid "SL" is interrupted, the brake lever 26 is unrestricted so that the brake band comes into contact with the circumferential surface of the brake drum to brake the spin-drying tub 18.

A drain valve 23 for opening or closing a drain port 22 of the outer tub 17 is provided below the outer tub 17 and is connected to the brake lever 26 via the connection lever 27. Thus, when the brake lever 26 is pulled to release the spin-drying tub 18, the drain valve 23 is opened, and when the brake lever 26 is unrestricted to brake the spin-drying tub 18, the drain valve 23 is closed.

Referring to FIG. 4, the washing machine according to the present invention includes a mode selection unit 21 for allowing a user to select an operation mode (washing, draining, and spin-drying mode) by using the first rotary knob 11 for mode selection, and a door switch 28 for supplying or interrupting power in response to an opening or closing of a door. The washing machine also has a washing timer 29 for allowing a user to select a washing time by using the second rotary knob 12 for setting washing time, a spin-drying timer 30 for allowing a user to select a spin-drying time by using the third rotary knob 13 for setting spin-drying time, a drain motor 24 connected to the spin-drying timer 30, and a motor driving circuit 31 connected to the washing timer 29.

The spin-drying timer 30 includes a spin-drying switch "SW4" and a motor control switch "SW5" different in their operation time. The spin-drying switch "SW4" is connected to a solenoid "SL" of the drain motor 24, and the motor control switch "SW5" is connected to the motor driving circuit 31 via a starting switch "SW3" of the drain motor 24.

Figure 5A:
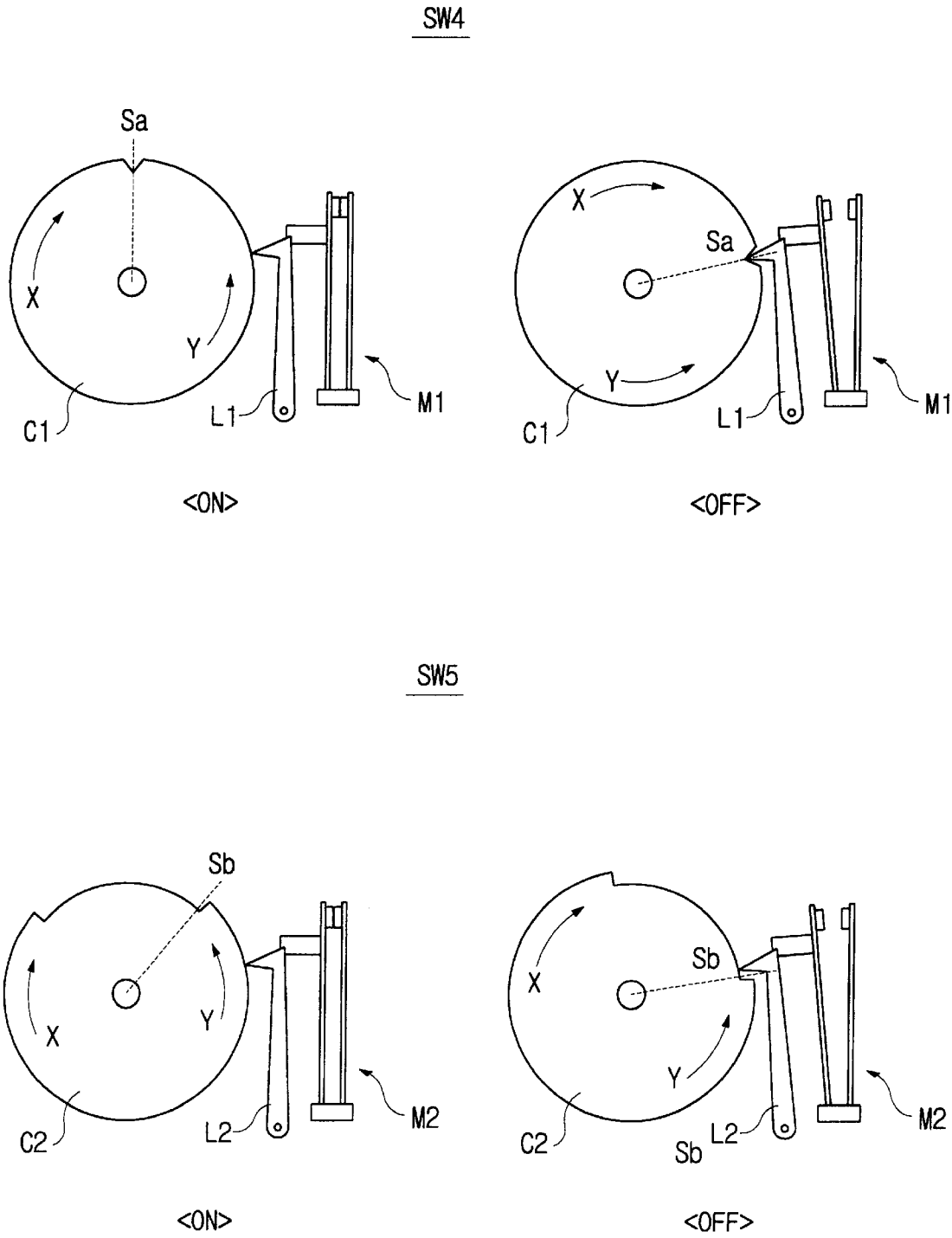
FIGS. 5*a* to 5*d* are views illustrating the operation of a spin-drying timer according to the present invention.
Figure 5B:
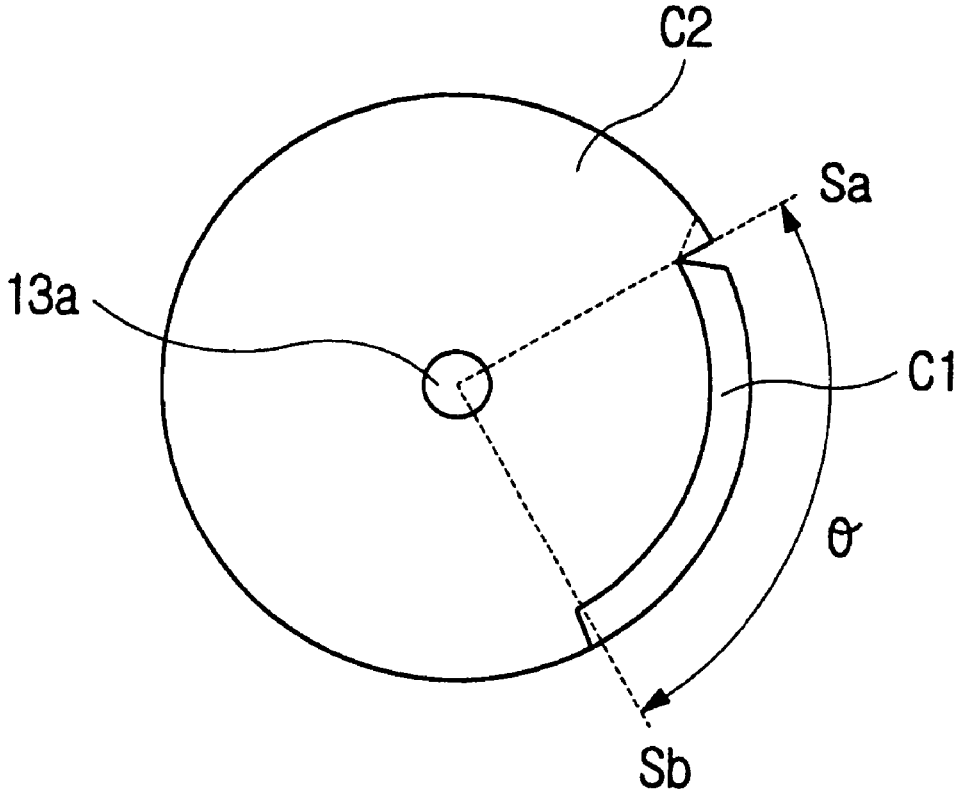

As shown in FIGS. 5*a* and 5*b*, the spin-drying switch "SW4" consists of a first cam "C1", a first actuation lever "L1", and a first contact point "M1", and the motor control switch "SW5" consists of a second cam "C2", an second actuation lever "L2", and a second contact point "M2". The spin-drying switch "SW4" and the motor control switch "SW5" are provided on the axis 13*a* of the third rotary knob 13 such that they are deviated from each other by a predetermined angle "θ". When a user selects the spin-drying time by rotating the rotary knob 13 in a counterclockwise direction "Y", the cams "C1" and "C2" are wound in a counterclockwise direction "Y". After this, as the spin-drying operation is progressed, the cams "C1" and "C2" are rotated in a clockwise direction "X" to return the cams "C1" and "C2" to their original positions when a selected spin-drying time is elapsed.

Figure 5C:
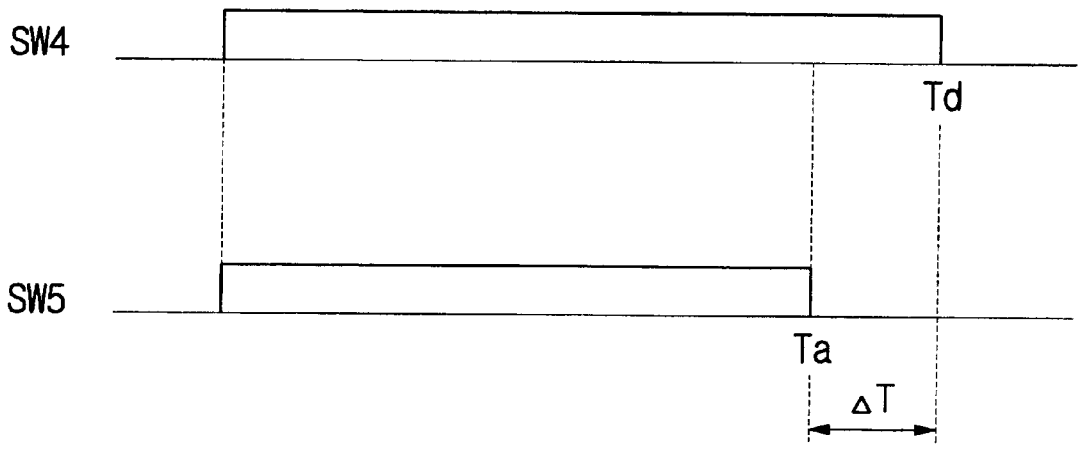

Since a reference position "Sa" of the first cam "C1" and a reference position "Sb" of the second cam "C2" are different from each other by a predetermined angle "θ", the spin-drying switch "SW4" is turned off after the motor control switch "SW5" is turned off. In other words, if a predetermined spin-drying time "Td" is selected by rotating the axis 13*a* of the third rotary knob 13 in the counterclockwise direction "Y", the spin-drying tub 18 is rotated by the motor 14 as both contact points "M1" and "M2" are turned on by the actuation levers "L1" and "L2". After this, as the spin-drying operation is progressed, the axis 13*a* is rotated in the clockwise direction X and, as shown in FIG. 5*c*, before the spin-drying time "Td" is passed, the actuation lever "L2" meets the reference position "Sb" to return to the original position of the cam "C2". At that time, as the motor control switch "SW5" is turned off at a point of time "Ta" at which the contact point "M2" is detached by the actuation lever "L2", power supplied to the motor driving circuit 31 is interrupted to stop the motor 14. In other words, the motor control switch "SW5" is turned off earlier than the spin-drying switch "SW4" by a predetermined time "ΔT".

The predetermined time "ΔT" is preferably set to be 10%–20% of the spin-drying time "Td". In the embodiment, the predetermined time "ΔT" is set as 1 minute if the spin-drying time "Td" is 6 minutes.

Figure 5D:
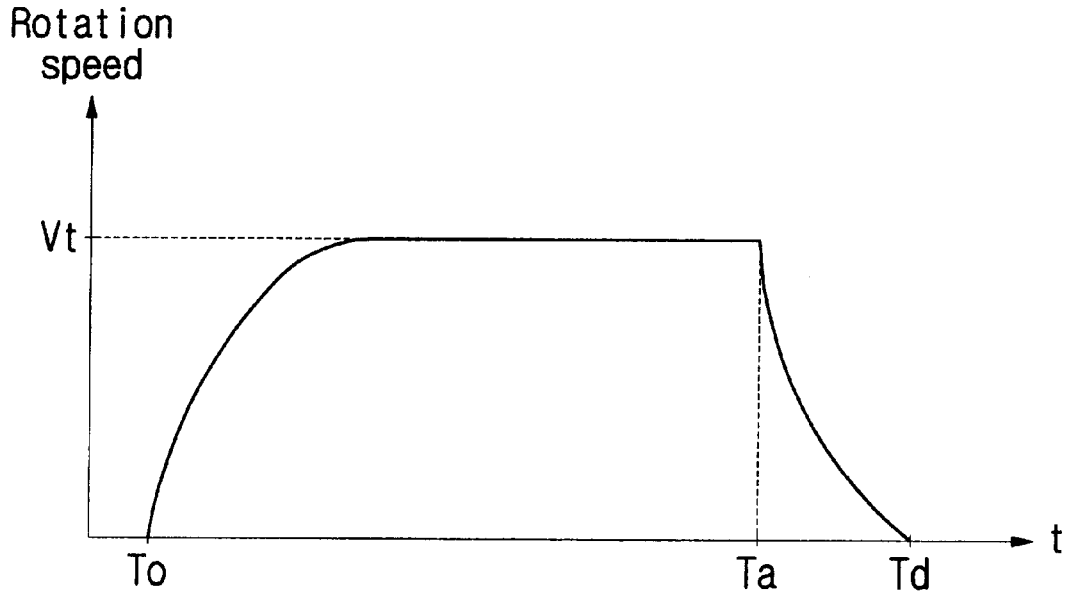

When the motor control switch "SW5" is turned off to interrupt power supplied to the motor 14, the spin-drying tub 18 continues to rotate by its own inertia and is reduced in its rotation speed. In other words, as shown in FIG. 5*d*, the rotation speed of the spin-drying tub 18 is increased until a target speed "Vt" arrives, starting at a start point "TO". While the spin-drying tub 18 arrived at the target speed "Vt" is being rotated at a high speed, when a time "Ta" at which the motor control switch "SW5" is turned off arrives, the motor is stopped and the spin-drying tub 18 continues to rotate by its own inertia. As the spin-drying tub 18 continues to rotate without power input by the motor, the rotation speed is reduced.

After this, when the spin-drying time "Td" is elapsed and the spin-drying switch "SW4" is turned off, power supplied to the solenoid "SL" of the drain motor 24 is interrupted and the brake lever 26 is unrestricted so that the brake band is brought into contact with the circumferential surface of the brake drum to brake the spin-drying tub 18. At this time, as the spin-drying tub 18 has been reduced remarkably in its rotation speed, it can be stopped by a small frictional braking force.

On the other hand, when the washing operation is finished and washing water is to be drained, the user selects a draining mode using the first rotary knob 11. As the first switch "SW1" of the mode selection unit 21 is switched to the "A" side by the rotary knob 11, power is supplied to the solenoid "SL" of the drain motor 24 via the door switch 28 and the spin-drying timer 30. The brake lever is pulled by the solenoid "SL" so that the brake band is detached from the brake drum and the drain valve 23 is opened to drain washing water through the drain port 22 of the outer tub 17. At the time, as the second switch "SW2" is turned off and power is not supplied to the motor driving circuit 31, the motor 14 is not driven.

Figure 6:
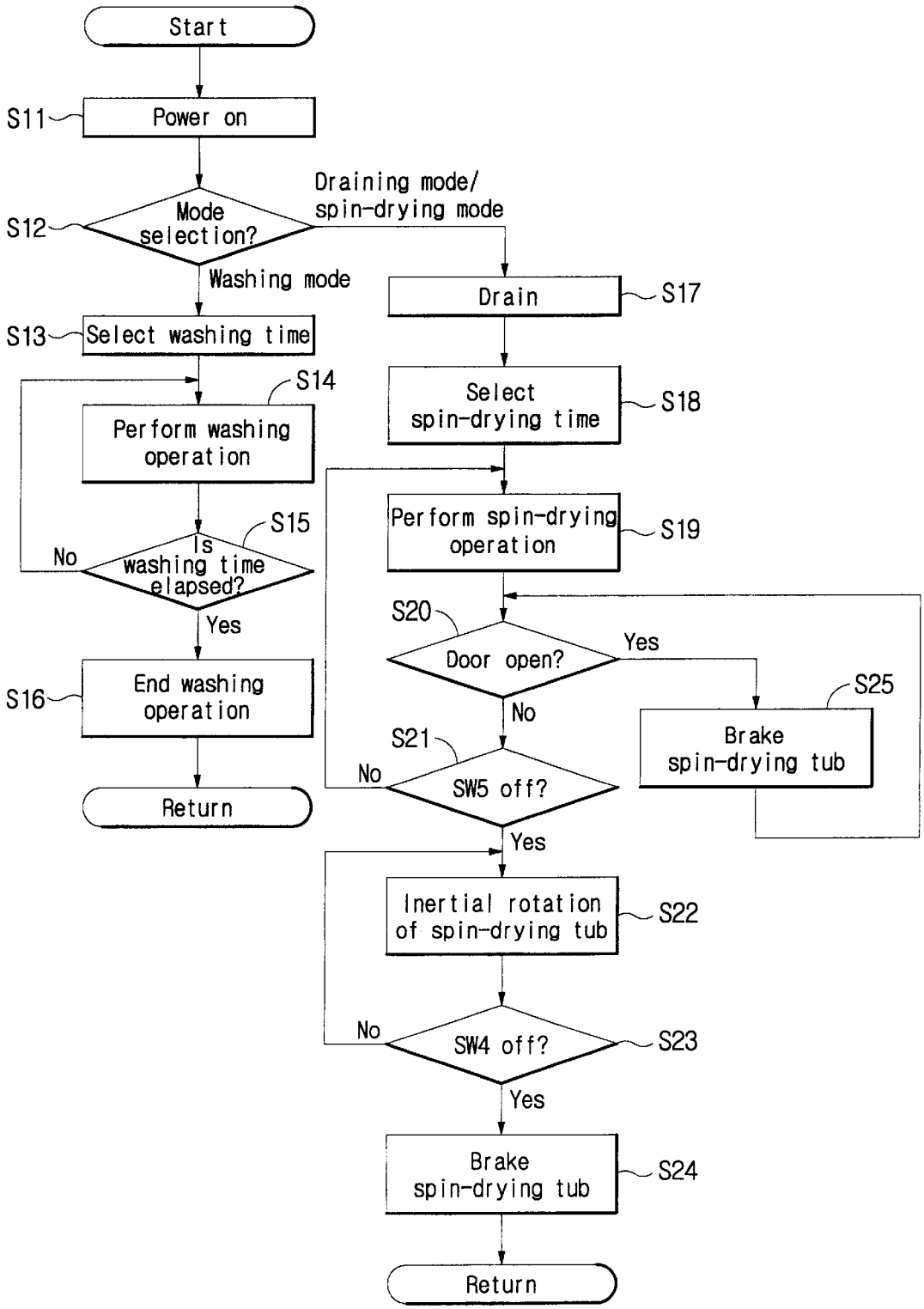
FIG. 6 is a flowchart for explaining a control method for a washing machine according to the present invention.

Now, a control method for the washing machine according to the present invention will be hereinafter described with reference to FIG. 6.

After power is inputted to the washing machine at step S11, the user selects a desired operation mode using the first rotary knob 11.

When it is desired to select a washing operation, a washing mode is selected by rotating the first rotary knob 11. In such a case, the first switch "SW1" of the mode selection unit 21 is switched to the "B" side (washing mode).

Thereafter, at step S12, it is determined which mode is selected. If a washing mode is selected, power is supplied to the motor driving circuit 31 via the washing timer 29 at step S13 during the washing time selected by the user.

Power is supplied to the motor 14 via the motor driving circuit 31 during the washing time set in the washing timer 29, and the pulsator 19 is repeatedly rotated in alternating directions by the motor 14 to perform the washing operation at steps S14–S16.

As power is not supplied to the drain motor 24 in the above washing mode, the brake lever 26 connected to the drain motor 24 via the connection lever is unrestricted so that the spin-drying tub 18 is braked and the drain valve 23 connected to the brake lever 26 via the connection lever 27 closes the drain port 22 of the outer tub 17.

On the other hand, after power is inputted to the washing machine, if a draining mode is selected by rotating the rotary knob 11, the first switch "SW1" of the mode selection unit 21 is switched to the "A" side and power is supplied to the solenoid "SL" of the drain motor 24 via the door switch 28 and the spin-drying switch "SW4" of the spin-drying timer 30. The brake lever is pulled by the solenoid "SL" so that the brake band is detached from the brake drum and the drain valve 23 is opened to drain washing water. At this time, as the second switch "SW2" is turned off and power is not supplied to the motor driving circuit 31, the motor 14 is not driven at steps S11, S12, and S17.

When the user selects a spin-drying mode by rotating the rotary knob 11, the first switch "SW1" of the mode selection unit 21 is switched to the "A" side and the second switch "SW2" is switched to the "C" side. In addition, when the user selects a spin-drying time "Td" by rotating the third rotary knob 13, the cams "C1" and "C2" corresponding to the spin-drying switch "SW4" of the spin-drying timer 30 and the motor control switch "SW5", respectively, are wound in a counterclockwise direction Y. Both the contact points "M1" and "M2" are turned on by the actuation levers "L1" and "L2" corresponding to the cams "C1" and "C2", respectively. As the contact point "M1" of the spin-drying switch "SW4" is turned on and power is supplied to the solenoid "SL", the brake lever 26 is pulled so that the spin-drying tub 18 is released and the drain valve 23 is opened. In addition, as the contact point "M2" of the motor control switch "SW5" is turned on, power is supplied to the motor driving circuit 31 via the starting switch "SW3" so that the motor 14 is rotated at a high speed to perform a spin-drying operation at steps S18 and S19.

While the spin-drying operation is performed by rotating the spin-drying tub 18 at a high speed as described above, it is determined whether a door of the washing machine is opened or closed at step S20. If the door is closed, it is determined whether the motor control switch "SW5" is in Off- or On-state at step S21. If the motor control switch "SW5" is in On-state, the process proceeds to step S19 to continue the spin-drying operation. If the motor control switch "SW5" is turned off at step S21, specifically if the contact point "M2" of the motor control switch "SW5" is turned off as a time "Ta" is elapsed before the spin-drying time "Td" is passed, power supplied to the motor driving circuit 31 via the starting switch "SW3" is interrupted. At this time, the rotation speed of the spin-drying tub 18 is reduced at step S22 as the tub 18 is rotated by its own inertia.

While the spin-drying tub 18 is rotated by its own inertia as described above, at step S23 it is determined whether the spin-drying switch "SW4" is turned off or on when a selected spin-drying time "Td" is elapsed. If the spin-drying switch "SW4" is not turned off, the process proceeds to step S22. If the spin-drying switch "SW4" is turned off when the spin-drying time is elapsed, power is not supplied to the solenoid "SL" of the drain motor 24 and the brake lever 26 connected to the drain motor 24 via the connection lever 25 is unrestricted so that the brake band comes into contact with the circumference of the brake drum to brake the spin-drying tub 18. At this time, as the spin-drying tub 18 has reduced remarkably in its rotation speed, a small frictional force is required to brake the spin-drying tub 18. In addition, the drain valve 23 connected to the brake lever 26 via the connection lever 27 closes the drain port 22 of the outer tub 17 at step S24.

On the other hand, when the door switch 28 is turned off by opening the door of the washing machine, power is not supplied to the solenoid "SL" of the drain motor 24 like when the washing mode is switched by the mode selection unit 11. In such a case, the brake lever 26 connected to the solenoid "SL" via the connection lever 25 is unrestricted so that the spin-drying tub 18 is braked and the drain valve 23 connected to the brake lever 26 via the connection lever is closed.

As described above, the washing machine of the present invention comprises a spin-drying timer including a spin-drying switch connected to a drain motor and a motor control switch connected to a motor driving circuit, each switch having a different operation time. In the washing machine, while a spin-drying operation is performed, power to the motor is interrupted by the motor control switch so that the spin-drying tub is rotated by its own inertia. When the spin-drying time is elapsed, the braking device is actuated by the spin-drying switch so that the inertially rotated spin-drying tub is braked. Accordingly, as braking is performed with a remarkably reduced frictional force, lifetime of the braking device is lengthened due to reduced abrasion of the brake band and the brake drum, and vibration and noise occurring at the time of braking of the spin-drying tub is decreased.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A washing machine selected in its operation mode and operation time by a user, comprising:

a spin-drying tub provided in an outer tub for performing both washing and spin-drying operations;

a motor for rotating the spin-drying tub;

braking means for braking the spin-drying tub;

mode selection means for selecting a spin-drying mode; and a spin-drying timer for interrupting power supplied to the motor before the spin-drying tub is braked in the spin-drying mode so that the spin-drying tub is rotated by its own inertia, wherein said spin-drying timer includes a spin-drying switch and a motor control switch, each of said switches having a different operation time, and the motor control switch being turned off earlier than the spin-drying switch.

2. The washing machine according to claim 1, wherein said spin-drying switch is connected between the braking means and the mode selection means, and said motor control switch is connected between the motor and the mode selection means.

3. The washing machine according to claim 1, wherein the spin-drying switch and the motor control switch are connected in parallel with the mode selection means.

4. The washing machine according to claim 1, wherein each of said switches comprises a cam mounted on an axis for rotating, an actuation lever provided outside the cam for actuating in different states according to the rotation of the cam, and a contact point for supplying or interrupting power according to the actuation state of the actuation lever.

5. The washing machine according to claim 1, wherein the motor control switch is turned off earlier by 10%–20% of spin-drying time.

6. The washing machine according to claim 1, wherein said motor control switch is turned off at a time earlier by 1 minute than spin-drying time.

7. A method of controlling a washing machine selected in its operation mode and operation time, comprising the steps of:

selecting a spin-drying mode and a spin-drying time;

rotating a spin-drying tub by supplying power to a motor in the spin-drying mode;

interrupting power to the motor when 90% of the selected spin-drying time has elapsed so that the spin-drying tub is rotated by its own inertia; and braking the spin-drying tub after the selected spin-drying time has elapsed.

8. The method of claim 7, said power being interrupted to the motor when a motor control switch turns off.

9. The method of claim 8, said braking occurring when a spin-drying switch is turned off, the spin drying switch being turned off one-tenth of the selected spin-drying time after the motor control switch is turned off.

10. The method of claim 9, power supplied to a solenoid of a drain motor is interrupted when said spin drying switch is turned off.

11. A washing machine, comprising:

a spin-drying tub provided in an outer tub performing both washing and spin-drying operations;

a motor rotating the spin-drying tub;

braking unit braking the spin-drying tub;

mode selection unit enabling a user to select a spin-drying mode and a spin-drying time; and a spin-drying timer for interrupting power supplied to the motor shortly before the expiry of the user selected spin-drying time when the spin-drying tub is braked in the spin-drying mode so that the spin-drying tub is rotated by its own inertia prior to application of the braking unit.

12. The washing machine of claim 11, further comprising a first switch that interrupts power to the motor and a second switch that causes the braking unit to brake the rotation of the spin drying tub.

13. The washing machine of claim 12, said first and said second switches each comprising a cam, an actuation lever that contacts said cam and a contact point, wherein the contact point opens circuit and causes the respective switch to turn off when the actuation lever is in contact with a notched reference position in the cam.

14. The washing machine of claim 13, the notched reference position of the first switch forms an angle with a reference position of the second switch, this angle being representative of the time delay between when power to the motor is interrupted and when the braking unit is applied to the spin-drying tub.

15. The washing machine of claim 11, the braking unit is connected to a drain motor so that the braking unit is applied to the spin-drying tub when the drain valve is closed and the braking unit is not applied to the spin-drying tub when the drain valve is open.

16. The washing machine of claim 11, wherein power to the motor is interrupted upon expiry of 90% of the selected spin-drying time.

17. The washing machine of claim 11, wherein power to the motor is interrupted upon expiry of 80% of the selected spin-drying time.

* * * * *